United States Patent [19]

Banich, Sr.

[11] 4,442,947

[45] Apr. 17, 1984

[54] PLASTIC CLOSURE WITH SEALING FLAPS

[75] Inventor: John N. Banich, Sr., Chicago, Ill.

[73] Assignee: Continental White Cap, Inc., Northbrook, Ill.

[21] Appl. No.: 459,064

[22] Filed: Jan. 18, 1983

[51] Int. Cl.[3] ..... B65D 53/00

[52] U.S. Cl. ..... 215/344; 215/DIG. 1

[58] Field of Search ..... 215/344, 341, DIG. 1

[56] References Cited

U.S. PATENT DOCUMENTS

| | | | |
|---|---|---|---|
| 3,203,571 | 8/1965 | Plunkett | 215/344 |
| 3,255,907 | 6/1966 | Eddy | 215/344 |
| 3,463,340 | 8/1969 | Lindstrom | 215/344 |
| 3,815,771 | 6/1974 | Marks | 215/344 |
| 4,069,937 | 1/1978 | Smalley | 215/344 |
| 4,072,244 | 2/1978 | Mueller | 215/344 |
| 4,090,631 | 5/1978 | Grussen | 215/341 |
| 4,143,785 | 3/1979 | Ferrell | 215/344 |

FOREIGN PATENT DOCUMENTS

| | | |
|---|---|---|
| 702113 | 1/1965 | Canada . |
| 2703404 | 8/1978 | Fed. Rep. of Germany . |
| 1213812 | 11/1959 | France . |
| 587755 | 5/1977 | Switzerland . |
| 607702 | 10/1978 | Switzerland . |
| 970531 | 9/1964 | United Kingdom . |
| 1229322 | 3/1971 | United Kingdom . |

OTHER PUBLICATIONS

Packaging Review, Jul. 1979, Obrist "Closures".

*Primary Examiner*—Donald F. Norton

*Attorney, Agent, or Firm*—Charles E. Brown

[57] ABSTRACT

This relates to a plastic material closure which is provided with deformable sealing flaps and cooperating abutments wherein when the closure is drawn down onto a container, the flaps will deform in accordance with the cross section of the sealing surface area of the container including down inside of the mouth of the container and down alongside the exterior surface of the neck finish to provide effective sealing contact with the container sealing area. Separate seals between the flaps and the container neck finish permit the same closure to be used to form gas-tight seals both with respect to high internal pressures and vacuum packs. The seals are liquid-tight and the closure may be used for reclosing the container against liquid loss.

10 Claims, 5 Drawing Figures

PLASTIC CLOSURE WITH SEALING FLAPS

This invention relates in general to new and useful improvements in closure caps, and more particularly to a closure cap which is capable of providing a linerless seal with a container neck finish utilizing one or more flaps wherein there is an abutment for each flap so positioned with respect to the flap wherein, when the flap is engaged by the container neck finish, it is first deformed away from the neck finish and then guided back into engagement with the neck finish by the abutment.

This invention in particular relates to a plastic closure with the capabilities of sealing the pressure generated by carbonated beverages and at the same time being capable of providing a hermetic seal for vacuum sealed packages. The closure relies solely on resilient flaps to effect the seal. The construction of the closure is also one wherein a liquid-tight seal may be obtained upon resealing of the container utilizing the closure.

In accordance with this invention, sealing flaps of the closure are directed by abutments into tight engagement with the end surface of a container neck finish with the free end portions of the flaps being deflected by abutments to positions down and around the sides of the neck finish.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
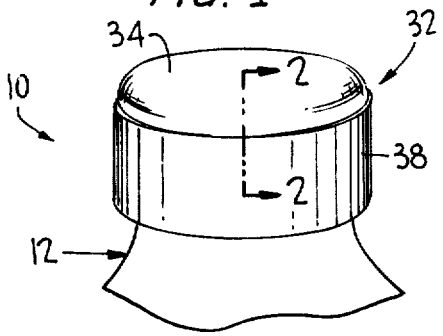
FIG. 1 is a fragmentary top perspective view of a conventional container closed by a closure formed in accordance with this invention.

Referring now to the drawings in detail, it will be seen that there is illustrated in FIG. 1 a conventional type of container which may be formed of glass or plastic and which, depending upon the product packaged therein, may be a container for carbonated beverage, a container for a product packed under vacuum conditions, or a container packed with a product wherein there is no pressure differential between the exterior and interior of the container.

The container is generally identified by the numeral 10 and has a neck portion 12 which is illustrated as having closure retaining means in the form of screw threads 14 on the exterior thereof for the purpose of drawing a closure down into sealing engagement thereon.

The neck portion 12 has a neck finish 16 which on the interior thereof defines a dispensing mouth 18 and generally at the axial end thereof a sealing surface area generally identified by the numeral 20. The sealing surface area 20 includes a generally planar annular end surface 22 defined by a pair of rounded corners 24, 26 with the corner 24 terminating in an inner side surface 28, which primarily defines the mouth 18, and an outer side surface 30.

At this time it is to be understood that while the illustrated threads 14 are continuous and are to be engaged by companion threads on a closure, the threads may be interrupted and be engaged by lugs on the associated closure.

The above-defined container structure, in and of itself, is old and does not form part of this invention. The invention particularly relates to a closure, generally identified by the numeral 32, for sealingly closing the container 10, the closure preferably being molded of a suitable plastic material as is conventionally utilized in the manufacture of closures of the type to which this invention relates.

The closure 32 includes an end panel 34 joined by a rounded corner 36 to a generally cylindrical skirt 38. In the illustrated embodiment of the invention, the inner surface of the skirt 38 is provided with threads 40 which cooperate with the threads 14 so as progressively to draw the closure 32 down on the neck portion of the container 10.

In order to effect a seal under all conditions between the closure 32 and the neck finish 16 of the container, the underside of the end panel 34 adjacent the corner 36 has integrally formed therewith a sealing flap assembly generally identified by the numeral 42. The sealing flap assembly 42 includes an outer frustoconical flap 44 and an inner frustoconical flap 46, the flaps 44, 46 converging toward the end panel 34. The sealing flap assembly 42 also includes an integral spacer 48 which extends between the flaps 44 and 46 and is in the form of an axial projection on the underside of the end panel 34. The spacer 48 has an exposed annular surface 50 which is engageable with the end surface 22.

It is to be noted that each of the flaps 44, 46 has first and second surfaces 52, 54 with the surfaces 52 opposing the container neck finish 16 and the surfaces 54 being remote surfaces. The surfaces 54 terminate in or join the end panel 34 along circular lines 56 which are spaced both axially and radially from circular lines 58 where the surfaces 52 join the spacer 48. This offsetting of the lines of juncture both axially and radially provides for a bending or flexing of the flaps 44, 46 in a manner wherein an effective seal is obtained between the flap assembly 42 and the sealing surfaces on the neck finish 16.

The underside of the end panel 34 is provided with a depending annular abutment 60 which is spaced radially inwardly of the flap 46 and has an abutment surface 62 which engages the flap 46 substantially midheight thereof. A similar abutment 64 having a flap engaging surface 66 extends inwardly from the corner 36 and also generally opposes its associated flap 44 generally at midheight.

Figure 2:
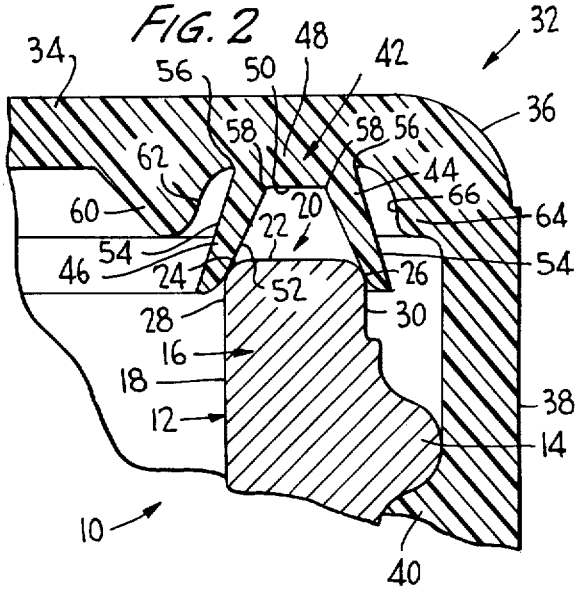
FIG. 2 is a vertical sectional view taken generally along the line 2—2 of FIG. 1, and shows a cross section through a corner portion of the closure and the relationship of the sealing flaps thereof with respect to the neck finish of the container when the flaps first engage the neck finish.
Figure 3:
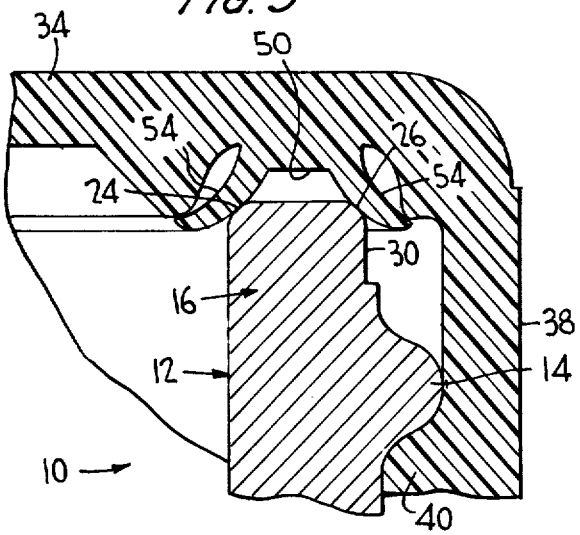
FIG. 3 is another fragmentary sectional view similar to FIG. 2, and shows the partially seated position of the flaps where they have been turned outwardly into engagement with the abutments.

In FIG. 2, the threads 40 have engaged the threads 14 and the closure 32 has moved down on the container neck portion 12 where the surfaces 52 of the flaps engage generally the corners 24, 26. At this time there is substantially a line contact between each of the flaps 44, 46 and the neck finish 16.

As the closure 32 is rotated, the threads 14, 40 coact to draw the closure 32 further down on the container with the flaps 44, 46 being deflected radially away from the sealing surface area 20 and maintaining substantially only line contact therewith. The surfaces 54 of the flaps 44, 46 have now engaged the abutments 64, 60, respectively.

Figure 4:
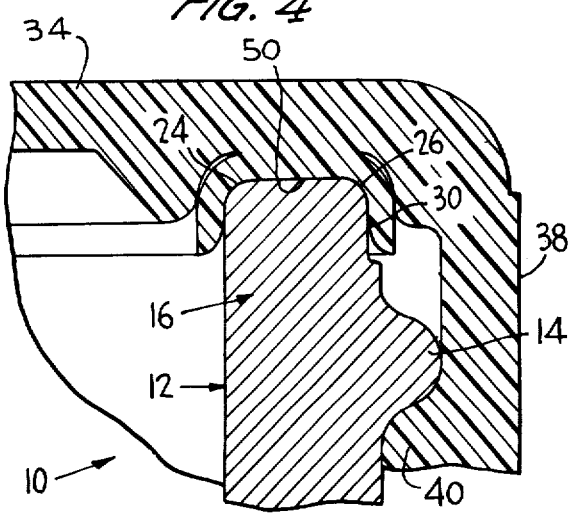
FIG. 4 is still another sectional view similar to FIG. 2, and shows the closure fully seated on the container neck finish.

As the closure 32 is further rotated and is drawn down onto the container 10 by the cooperating threads 14, 40, as shown in FIG. 4, the portions of the flaps 44, 46 adjacent the end panel 34 begin to flatten out and, in the final position of the closure 32, each flap 44, 46 is generally annular in cross section with the surface 50 of the spacer 48 fully engaging the end surface 22, the flap 44 being turned around the corner surface 26 in full engagement therewith and down alongside the side surface 30. In a like manner, the flap 46 extends generally horizontally from the spacer 48 and around the corner surface 24 in full engagement therewith and down alongside the side surface 28.

With particular reference to the relationship of the closure 32 with respect to the container 10, as shown in FIG. 4, it will be seen that the seal between the flap 46 and the sealing surface area 20 is one which will resist positive internal pressures. On the other hand, the seal between the flap 44 and the sealing surface area 20 is one which will prevent ingress of air when the product is vacuum packed. Thus, the same closure 32 provides two separate seals which permit a proper sealing of a container whether pressure packed or vacuum packed. Of course, the seal between the closure 32 and the container 10 is a liquid-tight seal and the closure may be used to reseal the container after initial opening.

Figure 5:
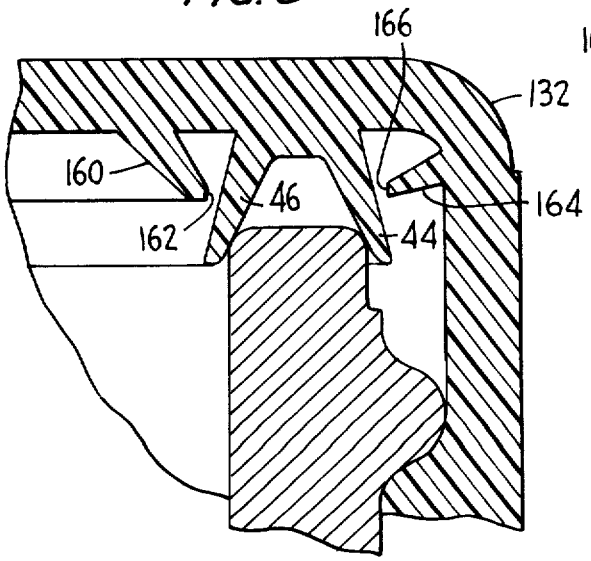
FIG. 5 is a fragmentary sectional view similar to FIG. 2, but showing a slightly modified form of abutment.

Reference is now made to FIG. 5 wherein a slightly modified form of closure 132 is illustrated. The closure 132 may be constructed in the same manner as the closure 32 except for abutments 160 and 164. These abutments are generally in the form of fins or ribs and may be, in and of themselves, slightly deflectable. The abutment 160 has a radially outer surface 162 for guiding engagement by the flap 46 while the abutment 164 has a radially inner surface 166 for guiding engagement with the flap 44.

It is to be understood that the abutments 160, 164 perform essentially the same functions as the abutments 60, 64 and that the shapes of the flaps 44, 46 in the fully seated position of the closure 130 will correspond to that shown in FIG. 4.

Although only specific embodiments of the closure have been illustrated and described herein, it is to be understood that minor variations may be made in the closure without departing from the spirit and scope of the invention as defined by the appended claims.

I claim:

1. A closure for a container, said closure comprising a cap-like member having an end panel and a depending skirt, said skirt carrying retaining means for locking engagement with a container and said end panel carrying sealing means for sealing engagement with a container, said sealing means including a frustoconical sealing flap depending from said end panel and having radially inner and outer surfaces, one of said surfaces being adapted to engage a container neck finish in sealing engagement, a protruding abutment having a primary flap engaging face facing the other of said surfaces and spaced from said other surface at only generally mid-length of said flap for restricting deflection of said flap when engaged with a container, said other surface being joined to said end panel in an area axially beyond and radially spaced from an area in which said one surface is joined to said end panel whereby said flap will automatically wrap around a container neck finish.

2. A closure according to claim 1 wherein said flap engaging face is disposed substantially concentric with said skirt.

3. A closure according to claim 1 wherein said flap is a radially outer flap and said abutment extends from a corner between said end panel and said skirt.

4. A closure according to claim 1 together with a container neck finish having a planar end sealing surface joined to a cylindrical side surface by a rounded corner, the relative positions of said flap and said abutment with respect to each other and said container neck finish being one wherein said flap is first bowed away from said side surface when engaged by said corner and then is guided by said abutment around said corner to a position adjacent to and generally engaging said side surface.

5. A closure for a container, said closure comprising a cap-like member having an end panel and a depending skirt, said skirt carrying retaining means for locking engagement with a container and said end panel carrying sealing means for sealing engagement with a container, said sealing means including a pair of radially spaced frustoconical flaps generally depending from said end panel and converging towards said end panel, said flaps being joined together generally at said end panel by an integral spacer extending between said flaps and depending from said end panel, said spacer having an exposed surface between said flaps for sealing engagement with an end surface of a container neck finish, and abutments initially spaced from said flaps generally at midheight of said flaps for cooperation with a container neck finish to deform free end portions of said flaps to generally concentric positions.

6. A closure according to claim 5 wherein remote surfaces of said flaps join said end panel in areas spaced axially and radially from areas where adjacent surfaces of said flaps join said spacer.

7. A closure according to claim 5 together with a container neck finish having a planar end sealing surface joined to cylindrical side surfaces by rounded corners, the relative positions of said flaps and said abutments with respect to each other and said container neck finish being one wherein each flap is first bowed away from the respective side surface when engaged by the respective corner and then is guided by the respective abutment around the respective corner to a position adjacent the respective side surface.

8. A closure and container neck finish combination as defined in claim 7 wherein said spacer exposed surface is of a width less than the width of said end sealing surface, and said flaps are deformed by said container neck finish and said abutments to extend radially from said spacer.

9. A closure and container neck finish combination as defined in claim 8 wherein the areas of connections of said flaps with said end panel generally lie within an extension area of said neck finish.

10. A closure and container neck finish combination as defined in claim 7 wherein said abutments face said side surfaces and are concentric therewith.

* * * * *